US012590343B2

(12) United States Patent
Saint-Raymond et al.

(10) Patent No.: US 12,590,343 B2
(45) Date of Patent: Mar. 31, 2026

(54) APPARATUS AND METHOD FOR DIP COATING A METAL STRIP USING A MOVEABLE OVERFLOW

(71) Applicant: ArcelorMittal, Luxembourg (LU)

(72) Inventors: Hubert Saint-Raymond, Metz (FR); Amico Settefrati, Essey-les-Nancy (FR); Bert Van Nieuwenhuyze, Ghent (BE); Kristof Van Dyck, Zoersel (BE); Freddy Kreps, Ghent (BE); Whoudhouh Memni, Paris (FR); Jose Veg, Brenouille (FR)

(73) Assignee: ArcelorMittal, Luxembourg (LU)

( * ) Notice: Subject to any disclaimer, the term of this patent is extended or adjusted under 35 U.S.C. 154(b) by 736 days.

(21) Appl. No.: 17/640,909

(22) PCT Filed: Sep. 3, 2020

(86) PCT No.: PCT/IB2020/058209
§ 371 (c)(1),
(2) Date: Mar. 7, 2022

(87) PCT Pub. No.: WO2021/048712
PCT Pub. Date: Mar. 18, 2021

(65) Prior Publication Data

US 2022/0290283 A1 Sep. 15, 2022

(30) Foreign Application Priority Data

Sep. 10, 2019 (WO) ..... PCT/IB2019/057602

(51) Int. Cl.
*C23C 2/00* (2006.01)
*C21D 1/26* (2006.01)
(Continued)

(52) U.S. Cl.
CPC ..... *C21D 1/26* (2013.01); *C21D 9/54* (2013.01); *C23C 2/0034* (2022.08);
(Continued)

(58) Field of Classification Search
None
See application file for complete search history.

(56) References Cited

U.S. PATENT DOCUMENTS 4,352,838 A * 10/1982 Bostroem ..... C23C 2/06 427/427
4,752,508 A * 6/1988 Sippola ..... C23C 2/0034 427/431
(Continued)

FOREIGN PATENT DOCUMENTS

CN 201217680 Y 4/2009
CN 102459683 A 5/2012
(Continued)

OTHER PUBLICATIONS

Search Report of PCT/IB2020/058209 dated Jan. 10, 2020.
Written Opinion of PCT/IB2020/058209.

*Primary Examiner* — Jethro M. Pence
(74) *Attorney, Agent, or Firm* — Davidson Kappel LLC

(57) ABSTRACT

An equipment for the continuous hot dip-coating of a metallic strip comprising: an annealing furnace, a tank containing a liquid metal bath, a snout connecting the annealing furnace and said bath, through which the metallic strip runs in a protective atmosphere and the lower part of said snout, the snout tip, is at least partly immersed in the liquid metal bath in order to define with the surface of the bath, and inside this snout, a liquid seal, a moveable support system, on at least one tank side, comprising connecting means, an overflow connected to said moveable support
(Continued)

system through said connecting means, comprising at least one vat and at a least one pump.

13 Claims, 7 Drawing Sheets

(51) Int. Cl.
*C21D 9/54* (2006.01)
*C23C 2/02* (2006.01)
*C23C 2/40* (2006.01)

(52) U.S. Cl.
CPC ..... *C23C 2/00342* (2022.08); *C23C 2/00344* (2022.08); *C23C 2/0036* (2022.08); *C23C 2/00362* (2022.08); *C23C 2/0038* (2022.08); *C23C 2/004* (2022.08); *C23C 2/02* (2013.01); *C23C 2/40* (2013.01)

(56) References Cited

U.S. PATENT DOCUMENTS 4,814,210 A * 3/1989 Ackermann ..... C23C 2/385 427/433
5,965,210 A * 10/1999 Tada ..... C23C 2/0035 427/598
5,989,645 A * 11/1999 Flores ..... C23C 2/0036 427/436
6,426,122 B1 * 7/2002 Ishii ..... C23C 2/522 427/431
6,770,140 B2 * 8/2004 Ishii ..... C23C 2/325 118/423
8,464,654 B2 * 6/2013 Barjon ..... C23C 2/0038 118/400
8,844,462 B2 * 9/2014 Onozawa ..... C23C 2/29 118/66
9,004,000 B2 * 4/2015 Koga ..... C23C 2/004 118/62
9,021,982 B2 * 5/2015 Koga ..... B05C 3/12 118/62
9,127,339 B2 * 9/2015 Hoshino ..... C23C 2/0038
9,133,540 B2 * 9/2015 Jang ..... C23C 2/0035
9,487,853 B2 * 11/2016 Jang ..... B05C 3/00
9,745,653 B2 * 8/2017 Schaffrath ..... C23C 2/00344
9,834,834 B2 * 12/2017 Yamauchi ..... B05C 3/04
10,941,474 B2 3/2021 Saint-Raymond et al.
11,124,863 B2 * 9/2021 Kayama ..... C23C 2/40
11,584,980 B2 * 2/2023 Garcia Martino ..... C23C 2/06
11,597,989 B2 * 3/2023 Frey ..... H01M 4/0485
11,850,634 B2 * 12/2023 Kümmel ..... C23C 2/004
2004/0028832 A1 * 2/2004 Dauchelle ..... C23C 2/00 427/431
2004/0052958 A1 3/2004 Dauchelle et al.
2012/0107636 A1 5/2012 Diez et al.
2016/0102393 A1 4/2016 Schaffrath et al.
2019/0062888 A1 * 2/2019 Saint-Raymond ..... C22C 18/04
2019/0144982 A1 5/2019 Veg et al.
2020/0399749 A1 * 12/2020 Garcia Martino ..... C21D 9/562
2022/0106674 A1 * 4/2022 Moon ..... C23C 2/00342

FOREIGN PATENT DOCUMENTS

CN 105358728 A 2/2016
CN 109988986 A 7/2019
FR 2 816 639 5/2002
JP S62148563 U 9/1987
JP H05302157 A 11/1993
JP 2001262303 A 9/2001
JP 2014065950 A 4/2014
JP 2019515129 A 6/2019
KR 200337666 Y1 1/2004
KR 200363077 Y1 9/2004
KR 100742958 B1 7/2007
KR 100782717 B1 12/2007
KR 1480341 B1 * 1/2015
WO WO 2017/187225 A1 11/2017
WO WO 2019/224617 A1 11/2019

* cited by examiner

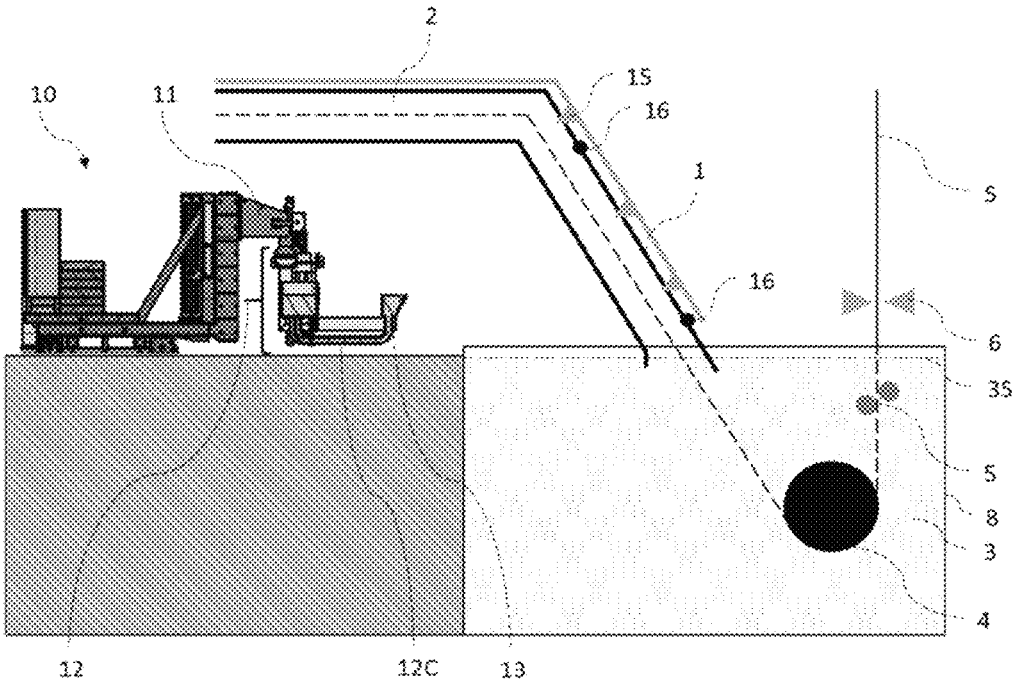
Figure 12
Figure 13A
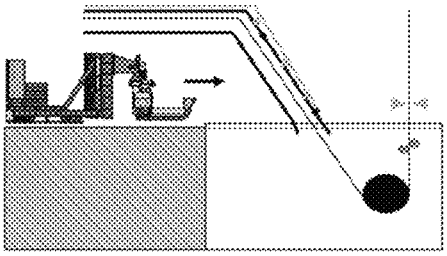
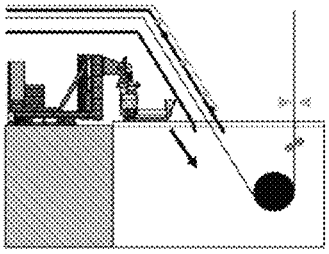
Figure 13B
Figure 13C
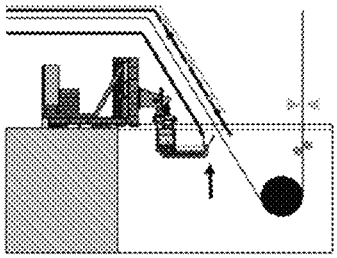
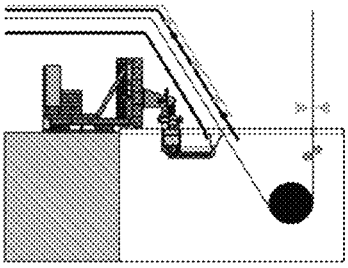
Figure 13D

APPARATUS AND METHOD FOR DIP COATING A METAL STRIP USING A MOVEABLE OVERFLOW

The present invention relates to equipment for the hot dip-coating of a metallic strip and two methods, one for positioning said equipment and one for coating a metallic strip.

BACKGROUND

In the steel industry, the rolled strips are generally coated with metallic and/or polymeric coatings to enhance their surface properties. The metallic coatings are generally deposited during a hot dip-coating process wherein a strip passes through a bath of molten metal.

Before entering into said bath, the strip generally undergoes several cleaning steps such as degreasing or brushing. Then the strip is heated prior to the hot-dip coating to avoid thermal choc and thus flatness defect. However, since the heated strip temperature is close to the bath one, generally between 400 and 800° C., the strip is subject to oxidation.

Therefore, to avoid such a detrimental phenomenon, the strip S is protected by a so-called snout 1, having a protective (non-oxidizing) atmosphere within, as illustrated in FIG. 1. This snout extends from the annealing furnace exit 2 to the molten metal bath 3. Moreover, the high temperature of the bath leads to its evaporation, including into said snout. In the snout, this metallic vapour tends to solidify because of the temperature decreases along the snout (when going upward) which leads to the formation of metallic particles falling into the bath 3. The hot-dip installation, as illustrated in FIG. 1, can also comprises a sink roll 4, stabilizing rolls 5 and a wiping system 6 permitting to control the coating thickness.

Furthermore, the bath of molten metal generally comprises a mix of several elements such as zinc, aluminium, silicon and or magnesium and its composition varies depending on the desired coating. The bath is usually fed using ingots and/or pre-melted metals. Due to inhomogeneities in the bath in terms of composition and temperature, particles such as dross can be formed.

Unfortunately, both particles, due to the metallic vapour solidification and the bath inhomogeneities, can float on the bath surface and stick to the metallic strip passing through the bath which can lead to surface defects.

Consequently, systems have been developed to avoid the adhesion of such particles on the strip surface by collecting the particles near the strip, especially near the strip S entrance into the bath 3. One of those systems is an overflow consisting of a vat (or a compartment) 7 placed in the lengthening of the snout 1 as disclosed in the patent FR 2 816 639 and illustrated in FIG. 2. Such a system permits to create a natural flow (illustrated by the arrow and the darker area) of the molten metal bath, particularly the floating undesirable particles, into said vat 7. Then the content of the overflow is pumped and rejected elsewhere. The pumping system is not represented in FIG. 2, only a pipe wherein the pumped molten metal and undesirable particles flow through, as illustrated by the arrow.

Patent application publication WO 2017/187225 also describes an apparatus for the continuous dip coating of a metal strip. This equipment improves the apparatus from patent FR 2 816 639 by allowing the position tuning of the snout and the overflows regards the strip. In order to do so, the snout is equipped with a mobile box of discharge in rotation in regard to the metal strip around a first axis of rotation and the box of discharge is mobile in rotation compared to the upper part of the sheath around a second axis of rotation. Moreover, the articulation allowing the rotation of the box of discharge compared to the upper part of the sheath is a pivot connection.

SUMMARY OF THE INVENTION

However, by using the above disclosed equipment, the right setting of the overflow is complex and, if not handled properly, may lead to inadequate positioning. The setting complexity is due to the difficulties of levelling both sides of the overflow by making a horizontal displacement without vertical displacement. Moreover, this needs lot of mechanisms leading to higher probability of failure. Furthermore, when one part is broken, in order to repair it, the whole snout has to be removed and sometimes replaced. Finally, there is a thermal gradient along the snout because the snout tip and the overflow are dipped into the molten metal bath while the highest part of the snout is in contact with ambient air. This thermal gradient leads to mechanical constraints and thus deformation of the snout and the overflow. After several cycles, where a snout tip is immersed and then not-immersed, the resulting deformation renders very difficult a correct positioning of the vat towards the bath surface because the upper edge is not horizontal anymore.

Consequently, due to the complex overflow positioning, the high failure risk of the mechanisms and the detrimental effect of the thermal gradient, a new overflow needs to be developed.

The purpose of this invention is to provide equipment for the hot dip coating of a metallic strip that eases the positioning of the overflow and improves the resilience of such an overflow in a molten metallic bath.

The present invention provides equipment for the continuous hot dip-coating of a metallic strip comprising:

- an annealing furnace (2),
- a tank (8) containing a liquid metal bath (3),
- a snout (1) connecting the annealing furnace (2) and said bath (3), said snout (1) comprising a snout tip (1B), which is at least partly immersed in the liquid metal bath (3) in order to define with the surface of the bath, and inside this snout, a liquid seal,
- a moveable support system (10), on at least one tank side, comprising a core part (18),
  - first moving means (19) able to move such moveable support system (10) at least in the horizontal direction, being on the ground and connected to said core part (18),
  - second moving means (20), connected to said core part (18) and to moveable support system connecting means (11), such that said support system connecting means (11) can be moved at least vertically by said second moving means (20)
- an overflow (12), not connected to said snout (1), comprising at least one vat (13) and at a least one pump (14), being movable to a working position in which said at least one vat (13) of the overflow (12) is placed in the vicinity of said snout tip (1B).
- wherein said overflow is fastened to said moveable support system by means of said connecting means (11).

The present invention also provides a method for depositing a metallic coating by hot-dip coating in an installation as described above comprising:

- the recrystallization annealing of the metallic strip in said annealing furnace the passage of the metallic strip from the annealing furnace to the hot-dip coating bath in the snout the hot dip-coating of the annealed metallic strip in said liquid metal bath.

The present invention also provides a method as described above, wherein said overflow is moved in at least three steps from an idle position to a working position:

horizontally, to place said vat above said bath, downward and askew, to place said vat horizontally below said snout tip and immersed in said liquid metal bath and such that said vat being encompassed by a vertical projection of said liquid seal, upward, to place said vat in said working position.

BRIEF DESCRIPTION OF THE DRAWINGS

Other characteristics and advantages will become apparent from the following detailed description of the invention.

To illustrate the invention, various embodiment will be described, particularly with reference to the following figures:

FIG. 12 shows an embodiment of an idle position of the overflow of the present invention.

FIGS. 13A, 13B, 13C, and 13D show an embodiment of the process of the present invention.

DETAILED DESCRIPTION

Figure 1:
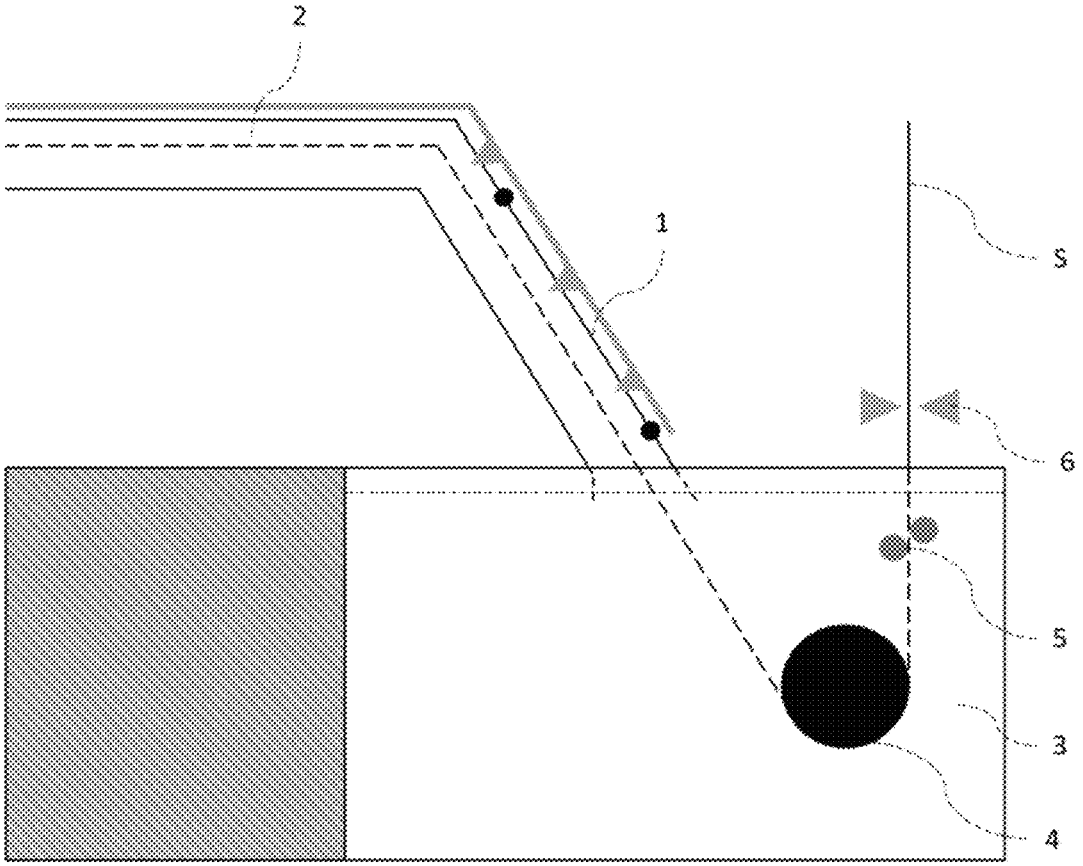
Figure 1 Prior Art
FIG. 1 shows an embodiment of a coating installation.
Figure 2:
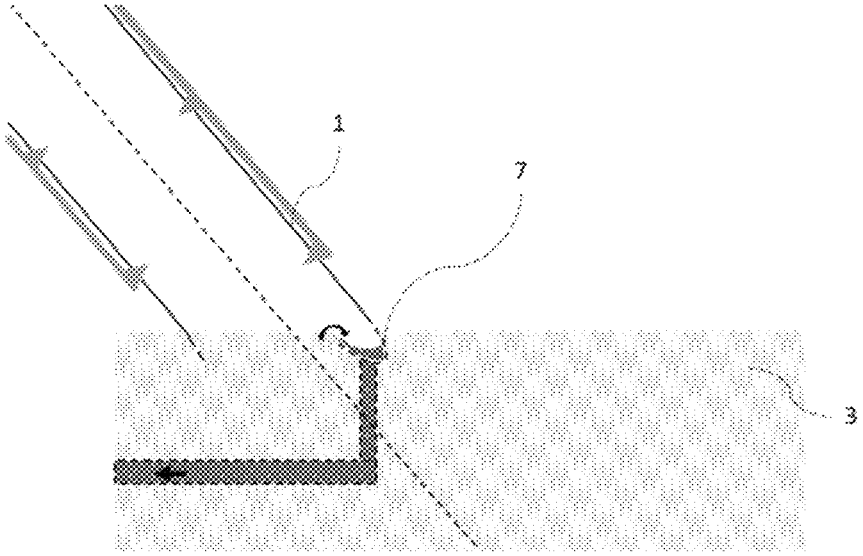
Figure 2 Prior Art
FIG. 2 shows an embodiment of an overflow as described in patent FR 2 816 639.
Figure 3:
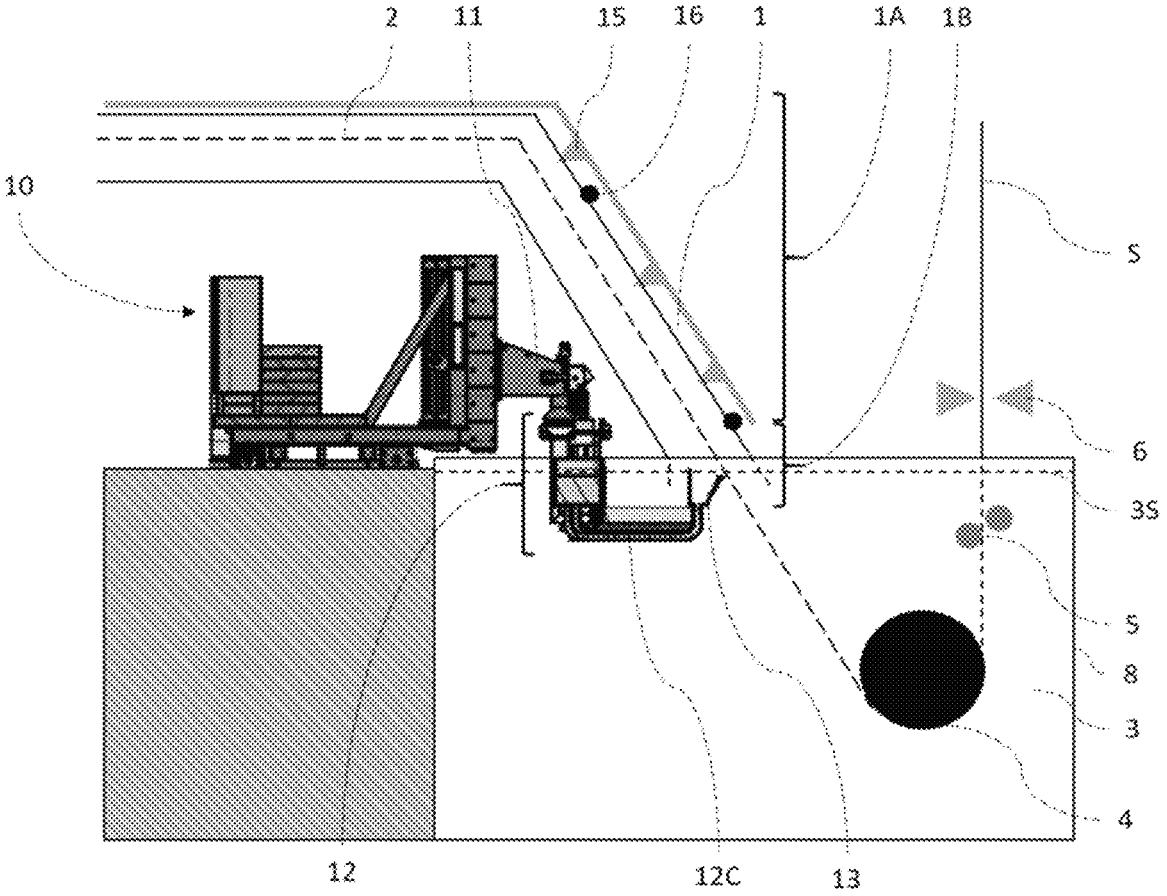
FIG. 3 shows an embodiment of the present invention.
Figure 7:
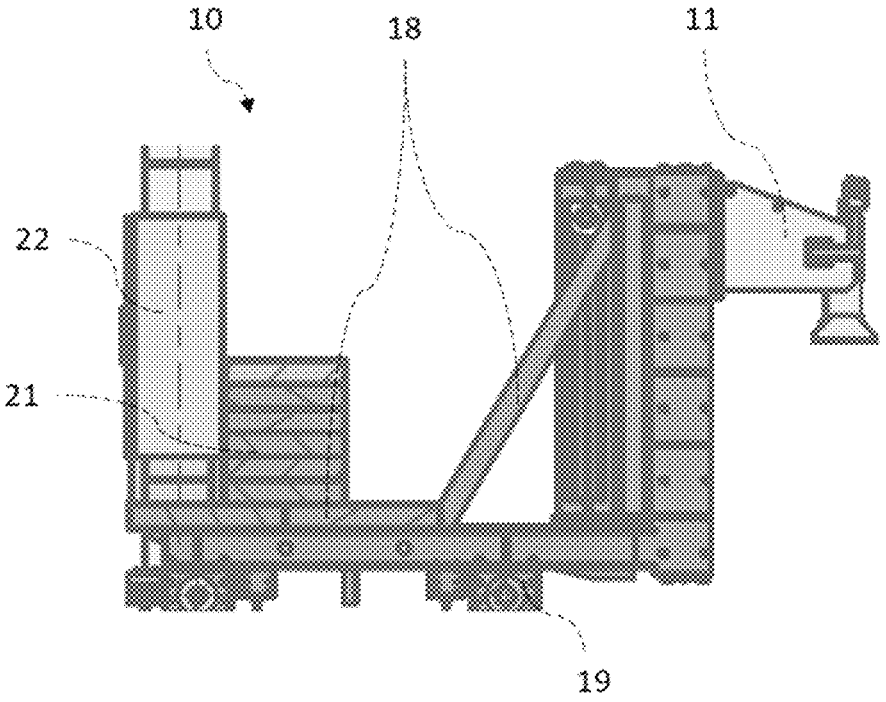
FIG. 7 exhibits a first view of a first embodiment of the moveable support system of the present invention.

As illustrated in FIGS. 3 and 7, the invention relates to equipment for the continuous hot dip-coating of a metallic strip comprising:

an annealing furnace 2, a tank 8 containing a liquid metal bath 3, a snout 1 connecting the annealing furnace 2 and said bath 3, said snout 1 comprising a snout tip 1B, which is at least partly immersed in the liquid metal bath 3 in order to define with the surface of the bath, and inside this snout, a liquid seal, a moveable support system (10), on at least one tank side, comprising a core part (18), first moving means (19) able to move such moveable support system (10) at least in the horizontal direction, being on the ground and connected to said core part (18), second moving means (20), connected to said core part (18) and to connecting means (11), such that said support system connecting means (11) can be moved at least vertically by said second moving means (20)

an overflow (12), not connected to said snout (1), comprising at least one vat (13) and at a least one pump (14), being movable to a working position in which said at least one vat (13) of the overflow (12) is placed in the vicinity of said snout tip (1B).

wherein said overflow is fastened to said moveable support system (10) by means of said connecting means (11).

As illustrated in FIG. 3, the tank may comprise a sink roll 4 and stabilizing rolls 5. Moreover, a wiping system 6, permitting to control the coating thickness, can be installed close to where the strip S exits the liquid metal bath 3. For clarity purposes, only a part of the annealing furnace is represented in FIG. 3.

The liquid metal bath 3 can be a mix of several elements such as zinc, aluminium, silicon and or magnesium. Preferably, the liquid metal bath is composed of at least 0 to 50% of aluminium, at least 20 to 30% of magnesium and at least 20 to 40% of silicon. Preferably, said liquid metal bath is composed of at least 0 to 95% of aluminium, at least 0 to 20% of magnesium and at least 0 to 15% of silicon. Preferably, said liquid metal bath is composed of 0 to 95% of zinc and 0 to 5% of aluminium. Preferably, said liquid metal bath is composed of 45 to 55% of zinc, 45 to 55% of aluminium and 0 to 20% of silicon.

The snout 1 can be a metallic hollow body having a rectangular section. Preferably, said snout comprises injection means 15, such as nozzles, to inject a non-oxidizing gas, such as nitrogen, into the snout 1 which permits to have a non-oxidizing atmosphere inside said snout. More preferably, as illustrated in FIG. 3, the snout comprises one or several means 16 permitting to tilt a portion of the snout. Tilting one or several portions of the snout is particularly advantageous during maintenance operation. The snout comprises two parts, the snout body 1A and the snout tip 1B.

The snout tip 1B is at the lower end of the snout, closer to the liquid metal bath. Moreover, said snout tip is at least partly immersed in said liquid metal bath while in operation. It permits to define with the bath surface and inside said snout a liquid seal hindering the ambient air to enter into the snout from the snout tip side which preserves the non-oxidizing atmosphere. Said snout tip can have the same section or a different section compared to the one of the snout body.

Preferably, as illustrated in FIG. 3, the snout tip has a larger section compared to the one of the snout body. It permits to ease the positioning of the vat because there is more space. Even more preferably, a portion of the rear side of the snout tip is vertical, e.g. perpendicular to the ground, as illustrated in FIG. 3.

The moveable support system eases the positioning of the vat. It also permits to set the overflow in a working position without moving said snout.

Figure 8:
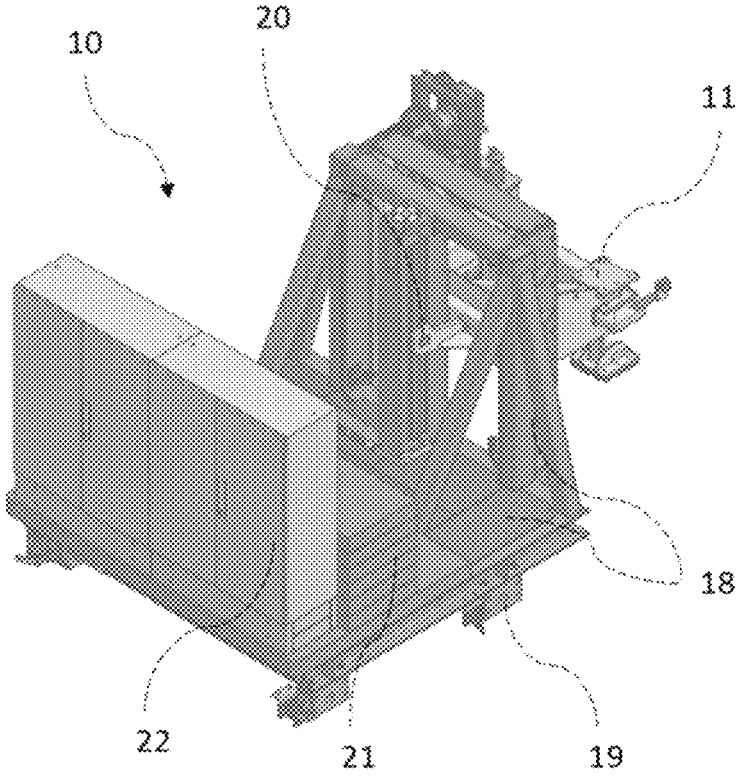
FIG. 8 exhibits a second view of a first embodiment of the moveable support system of the present invention.

The core part(s) 18 of the moveable support system 10 is mainly used to connect all the other parts of said support system 10 and to provide stability. (See, e.g., FIG. 7) Therefore, the core part 18 can also comprise a counterweight 21 placed to balance the moveable support system 10 in relation to the weight of the connected overflow 12. The core part can also comprise means 22 to provide electricity to the moving means (19 and 20). (See, e.g., FIG. 8).

The first moving means 19 permits to move the moveable support system 10 at least horizontally, it can be a bogie and/or at least one-wheel hub motor. Preferably, the first moving means moving horizontally moves in only direction being along a tank edge. Such a unidirectional movement of the first moving means eases the positioning of the overflow, e.g. the vat, because only one direction needs to be controlled. Obviously, in the case where the first moving means can only move unidirectionally, it should permit the positioning of the overflow in said working position.

The second moving means 20 is connected to said support system connection means 11 to permit its vertical displacement and thus the vertical the displacement of said fastened overflow. The second moving system can be a sliding guide, an actuator and/or a hoist.

Figure 4:
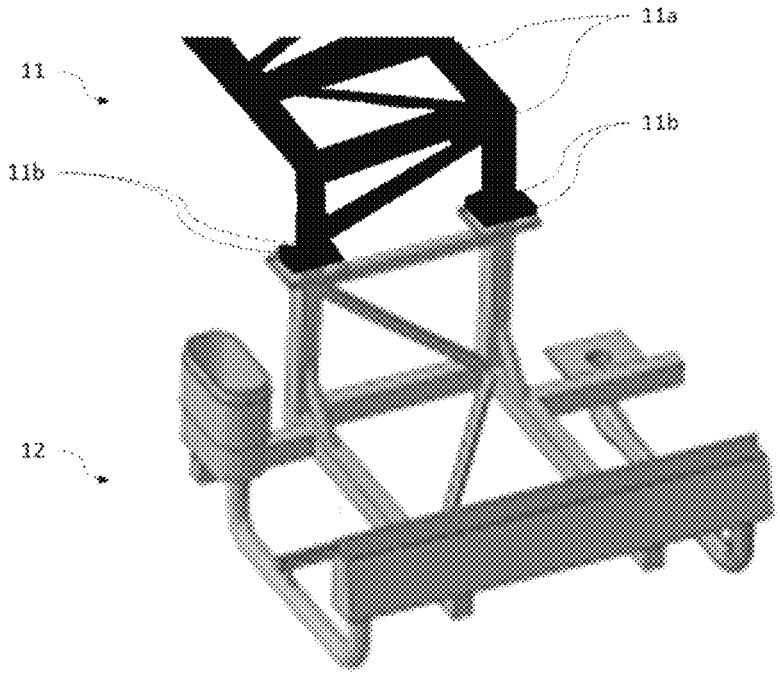
FIG. 4 exhibits an embodiment of connecting parts and of an overflow of the present invention.

Moreover, the connecting means 11 can comprise any practical fastening means, such as nuts and bolts, welds and/or rivets and any practical connection parts, such as beams. An embodiment a connecting means 11 is illustrated in FIG. 4, wherein the connecting means 11 are made of beams 11*a* and bolts 11*b*, said bolts being attached to an overflow 12.

Figure 5:
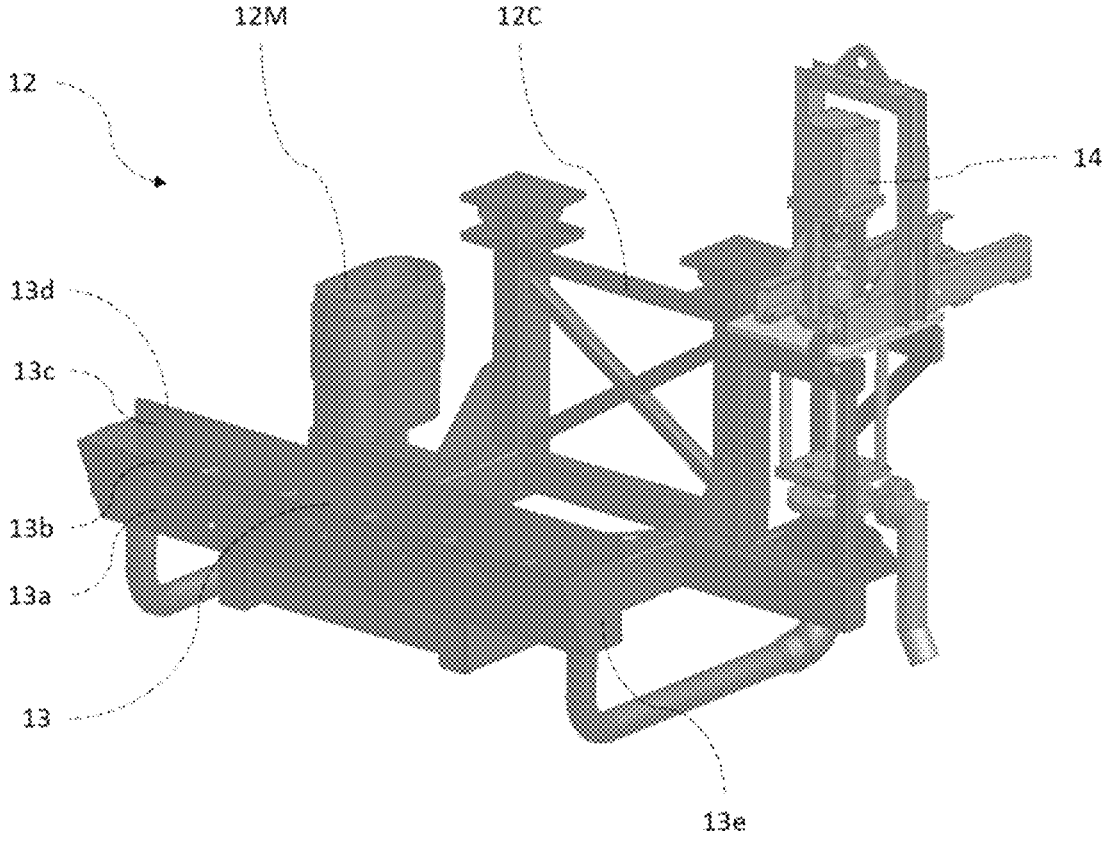
FIG. 5 shows an embodiment of an overflow of the present invention.

As illustrated in FIGS. 3 and 5, the claimed equipment also comprises an overflow 12 fastened to said moveable support system 10 by means of said connecting means 11.

Figure 6A:
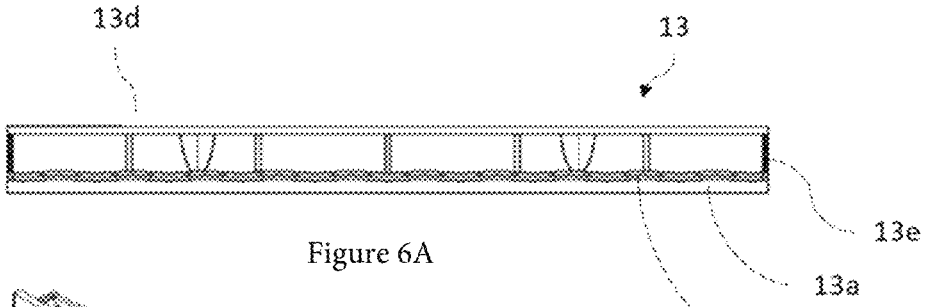
FIGS. 6A and 6B shows two views of an embodiment of a vat of the present invention.
Figure 6B:
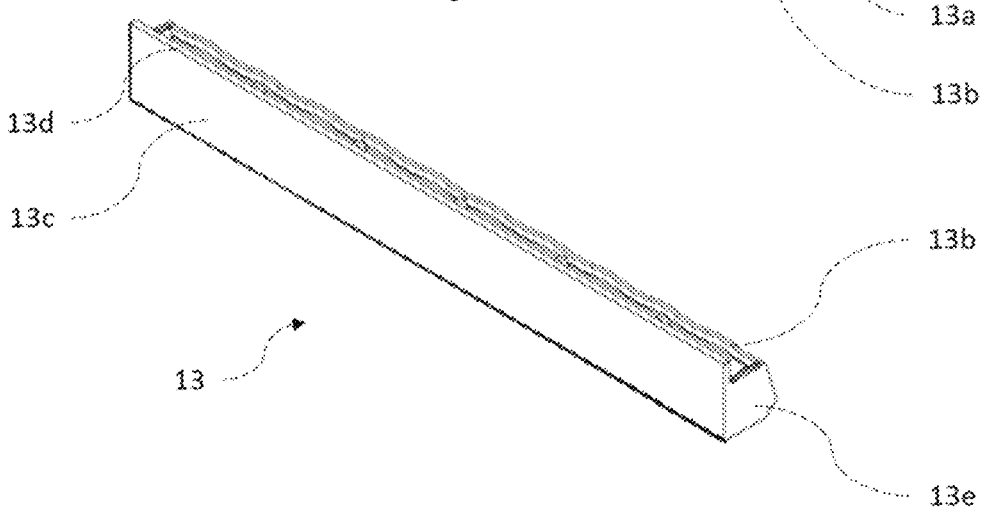

Said overflow 12 is not connected to said snout 1. It means that the overflow and the snout are two distinct elements, they are not fixed one to another. As already briefly explained, in the patents WO 2017/187225 and FR 2 816 639, there is a thermal gradient between the immersed parts, e.g. a portion of the snout tip and the overflow, and the non-immersed part. This thermal gradient leads to a difference in terms of thermal dilation and thus in terms of deformation between the immersed parts and the non-immersed parts. Consequently, it leads to a deformation of the vat, notably the upper internal edge which can result in an upper edge being tilted and makes it difficult to correctly position the vat. However, with this claimed equipment, because the snout and the overflow are apart, there is no problem linked to this deformation Moreover, as illustrated in FIGS. 6A and 6B, said overflow 12 comprises at least one vat 13, at least one pump 14 and connecting means between the vat and the pump. Said at least one pump 14 is connected to the vat 13, preferably the bottom of said vat. Such a system permits to pump out the molten metal and the undesirable particle. This system can be made of a pipe connecting said vat to said pump and connecting said vat to an area outside of the snout, said area being preferably away from the strip. In the frame of this invention, a vat 13 can be understood as a flat, shallow container with a raised rim. As illustrated in FIGS. 6A and 6B, a vat can be composed of:

- an internal wall 13*a* facing one side of the strip, directed toward the surface of the liquid seal, comprising an upper edge 13*b*,
- an external wall 13*c* facing the snout, directed toward the surface of the liquid seal, comprising an upper edge 13*d*,
- a connection part between said external and internal wall lower edges,
- a wall 13*e* at each shared extremity of the previous mentioned walls connecting all the edges,
- said internal wall upper edge 13*b* being below than the external wall upper edge 13*d*.

In this case, because the overflow is place in the vicinity of said snout tip 1B, it means that the upper edges of the internal and external wall are within the volume defined by the snout tip 1B.

Preferably, in said working position, said internal wall 13*a* is immersed in said bath 3 and said external wall 13) is only partly immersed in said bath. It permits to enhance the removal of the undesirable particles.

Preferably, as illustrated in FIG. 5, said overflow also comprises a level measuring means 12M permitting to an operator to check the correct positioning of the overflow.

Moreover, said overflow is movable to a working position which means that the overflow position is not fixed in relation to the bath and/or the snout, but it can be moved from a position not being a working position to a working position. As illustrated in FIG. 3, in the working position, said at least one vat 13 of the overflow 12 is placed in the vicinity of said snout tip 1B. Such a position permits to set up a natural flow of the molten metal bath 3 into the vat 13. The working position of said vat 13 can also be characterized by the facts that the upper edge 13*b* of the internal wall 13*a* is positioned below the surface 3S (illustrated in FIG. 3) of the molten metal bath 3 permitting said natural flow of the molten metal into the vat 13 and that the upper edge 13*d* of the external wall 13*c* is positioned above the surface of said bath. More preferably, the height of said natural flow of the liquid metal is greater than 50 mm in order to prevent metal oxide particles and intermetallic compound particles from rising as a countercurrent to the flow of liquid metal.

Consequently, this invention permits to ease the positioning of the overflow and supress or at least limit the resilience of such an overflow in a molten metallic bath.

Figure 9:
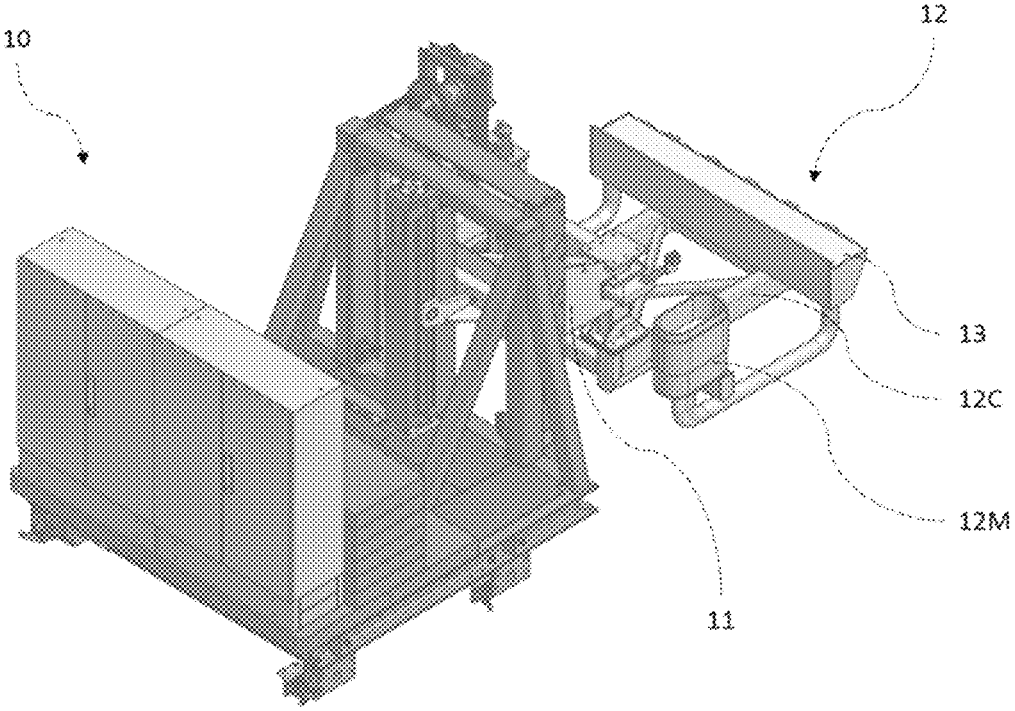
FIG. 9 shows an embodiment of the moveable support system and an overflow of the present invention.

Preferably, as illustrated in FIG. 9, said overflow comprises a core part 12C and said support system connecting means 11 being connected to said overflow by said core part 12C. Such a connection enhances the robustness of the equipment. Even more preferably, said core part 12C supports said vat 13 and said pump 14. The core part 12C can comprise fastening means and connections part permitting to support said overflow and said pump.

Preferably, said first moving means 19 comprises at least one rail and at least a bogie. This is advantageous because it eases the positioning of the overflow because a displacement following a rail is repeatable. Apparently, the parallelism and the horizontality of the displacement towards the ground is eased Preferably, said moveable support system 10 moves said overflow 13 from a working position to an idle position, in said idle position, said overflow being placed outside and not above said liquid metal bath. Generally, when the overflow is in an idle position, maintenance operations can be done on the overflow. An embodiment of an idle position is represented FIG. 12.

The invention also relates to a method for depositing a metallic coating by hot-dip coating, in an installation as previously described, comprising:

- the recrystallization annealing of the metallic strip in said annealing furnace
- the passage of the metallic strip from the annealing furnace to the hot-dip coating bath in the snout
- the hot dip-coating of the annealed metallic strip in said liquid metal bath.

Preferably, as illustrated in FIG. 3, said moveable support system 10 is positioned on only one side of said tank 8. Preferably, as illustrated in FIG. 3, said moveable support system is positioned on only one side of said tank 8.

Preferably, as illustrated in FIG. 3, said moveable support system 10 is positioned on a rear side of said tank 8, said read side being a side under said snout 1. Generally, the hot-dip coating installations have free space behind the snout, so such a positioning is advantageous because the whole hot-dip installation does no need to be modified to permit the use of said support system. Moreover, is eases the access to the moveable support system.

Figure 10:
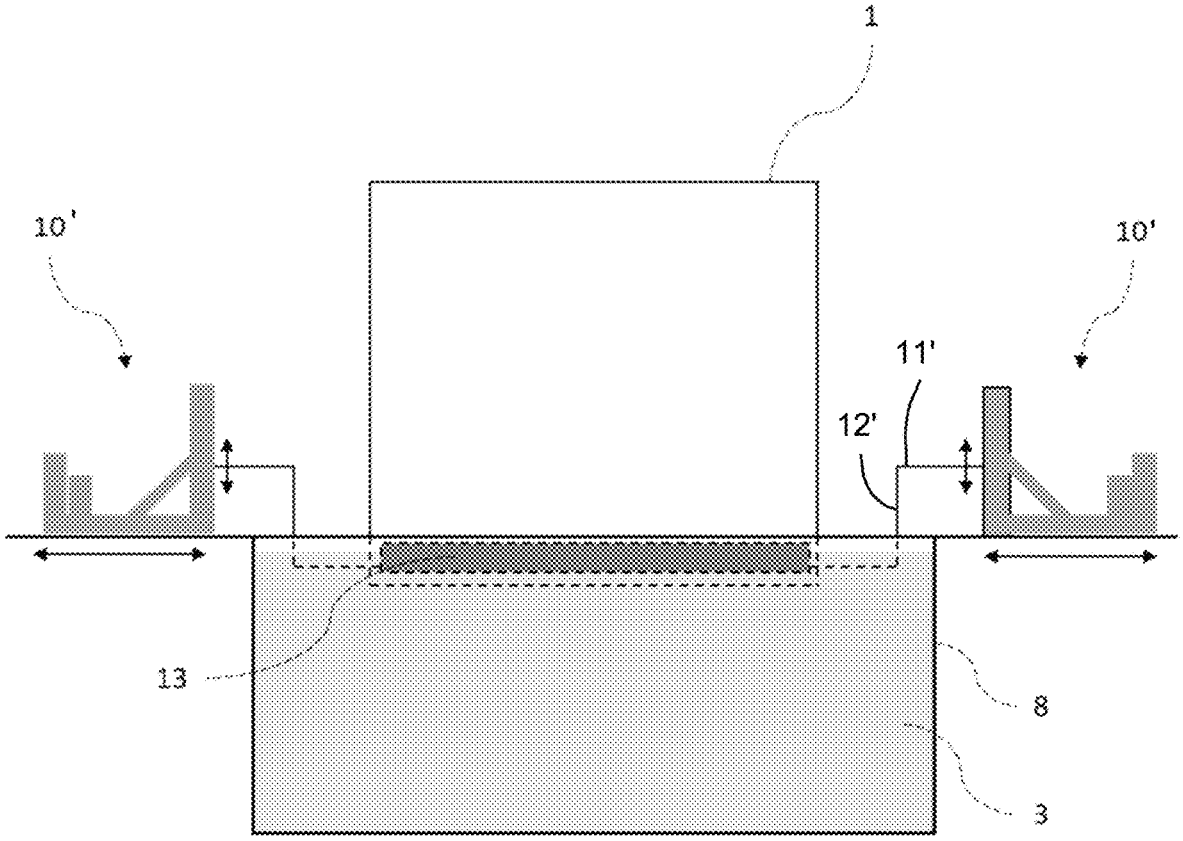
FIG. 10 exhibits a first view of a second embodiment of the moveable support system and an overflow of the present invention.
Figure 11:
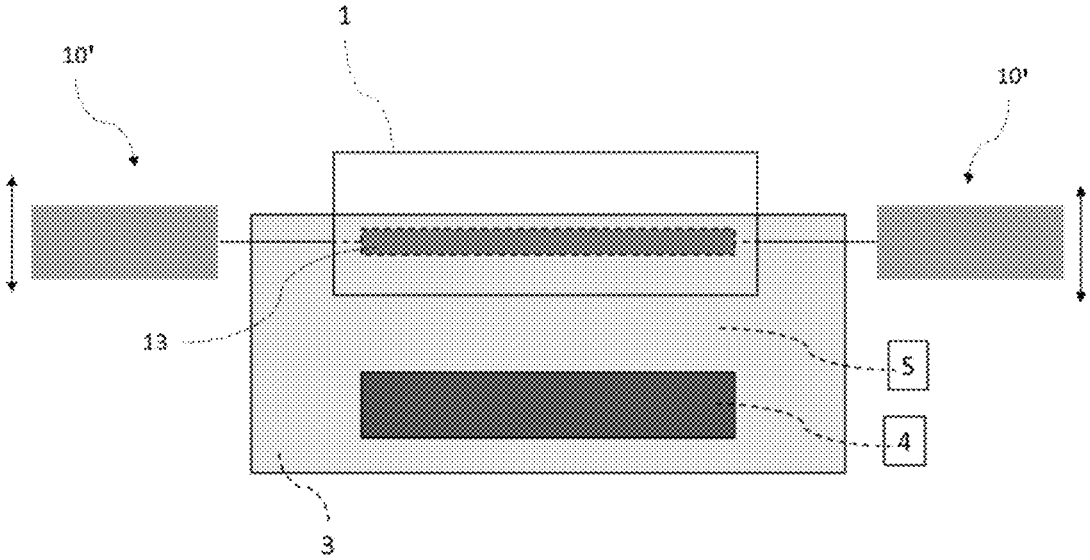
FIG. 11 exhibits a second view of a second embodiment of the moveable support system and an overflow of the present invention.

Preferably, as illustrated in FIGS. 11 and 12, said strip S passing through said liquid metal bath 3 describes a path, said moveable support system 10 being positioned on two lateral sides of said tank 8, said lateral sides being along said path. This placement of the support system eases the positioning of the vat because the vat alignment in relation to the strip can be done by the horizontal displacement of the first moving means. In this case, there is one support system on each lateral sides of the tank. FIG. 10 is a front view of the installation, wherein the overflow 12' is supported by two moveable support system 10' though connecting means 11'. FIG. 11 is a top-down view of the installation. Moreover, it permits to lower the weight of the counterweight because apparently, the lever arm would be smaller. Even more preferably, said strip passing through said bath 3 describes a path, said moveable support system 10 being positioned only on two lateral sides of said bath, said lateral sides being along said path.

Preferably, as illustrated in FIG. 3, said vat 13 is positioned between said strip S and a rear side of said snout. Such a positioning is advantageous because when the metal vapour solidifies on the rear side of the snout it can fall into the vat which increases the impurities quantity taken by the vat. On the contrary, when the metal vapour solidifies on the front side of the snout, it tends to fall on the strip. Consequently, when the vat 13 is positioned on the rear side of the snout, the falling impurities are more easily collected compared to the case where the vat is position on the front side of the snout.

The invention also relates to a method for positioning, in an installation as previously described, an overflow wherein said overflow is moved in at least three steps from an idle position to a working position:

horizontally, to place said vat above said bath, downward and askew, to place said vat horizontally below said snout tip and immersed in said liquid metal bath and such that said vat being encompassed by a vertical projection of said liquid seal, upward, to place said vat in said working position.

The different steps of said method are illustrated in FIGS. 13A, 13B, 13C and 13D.

Preferably, in said idle position, said overflow is positioned outside and not above said liquid metal bath, as illustrated in FIG. 13A). It permits to do maintenance work on the overflow, to change the overflow if needed. Moreover, it also permits to change the bath.

Such movement permits to efficiently place the vat in its working position. Then the vat position can be tuned to adjust the vat inclinations. The second movement, downward and askew, is preferentially done at 45° to the vertical.

Preferably, said overflow is moved at least four times from an idle position to a working position:

horizontally, to place said vat above said bath, downward, to place said vat horizontally below said snout tip and immersed in said liquid metal bath, horizontally, such that said vat being encompassed by a vertical projection of said liquid seal, upward, to place said vat in said working position.

Such movement permits to efficiently place the vat in its working position. Then the vat position can be tuned to adjust the vat inclinations.

The invention has been described above as to the embodiment which is supposed to be practical as well as preferable at present. However, it should be understood that the invention is not limited to the embodiment disclosed in the specification and can be appropriately modified within the range that does not depart from the gist or spirit of the invention, which can be read from the appended claims and the overall specification.

What is claimed is:

1. Equipment for the continuous hot dip-coating of a metallic strip comprising:

an annealing furnace;

a tank containing a liquid metal bath;

a snout connecting the annealing furnace and the bath, the snout including a downwardly extending snout tip at least partly immersed in the liquid metal bath in order to define, with a surface of the bath, and inside the snout, a liquid seal;

a moveable support system, on at least one side of the tank, including:

a core part;

a first conveyor able to move the moveable support system at least in the horizontal direction, being on ground and connected to the core part; and a second conveyor connected to the core part and to a moveable support system connector, such that the support system connector is movable at least vertically by the second conveyor;

an overflow, not connected to the snout, including a vat and a pump, being configured to move to a working position where the vat of the overflow is placed in a vicinity of the snout tip, wherein the overflow is fastened to the moveable support system via the support system connector.

2. The equipment as recited in claim 1 wherein the overflow comprises an overflow core part and the support system connector is connected to the overflow by the overflow core part.

3. The equipment as recited in claim 2 wherein the overflow core part supports the vat and the pump.

4. The equipment as recited in claim 1 wherein the first conveyor comprises at least one rail and at least a bogie.

5. The equipment as recited in claim 1 wherein the vat includes:

an internal wall facing one side of the metallic strip, directed toward the surface of the liquid seal, comprising an upper internal wall edge;

an external wall facing the snout, directed toward the surface of the liquid seal, comprising an upper external wall edge;

a connection part between lower edges of the external wall and the internal wall;

a wall at each shared extremity of the internal wall and the external wall connecting the lower edges and the upper internal wall edge, and the upper external wall edge; and the upper internal wall edge being below the upper external wall edge.

6. The equipment as recited in claim 1, wherein the snout extends from the annealing furnace to the bath.

7. The equipment as recited in claim 1, wherein the snout includes a snout body positioned above the tank, the snout tip being connected to a bottom of the snout body.

8. A method for depositing a metallic coating by hot-dip coating in the equipment as recited in claim 1, the method comprising:

recrystallization annealing the metallic strip in the annealing furnace;

passing the metallic strip from the annealing furnace to the hot-dip coating bath in the snout; and hot dip-coating the annealed metallic strip in the liquid metal bath.

9. The method as recited in claim 8 wherein the moveable support system is positioned on only one side of the tank.

10. The method as recited in claim 8 wherein the metallic strip passing through the liquid metal bath describes a path, the moveable support system being positioned on two lateral sides of the tank, the lateral sides being along the path.

11. The method as recited in claim 8 wherein the vat is positioned between the metallic strip and a rear side of the snout.

12. The method as recited in claim 8 wherein the overflow is moved in at least three steps from an idle position to a working position:

horizontally, to place the vat above the bath, downward and askew, to place the vat horizontally below the snout tip and immersed in the liquid metal bath and such that the vat is encompassed by a vertical projection of the liquid seal, upward, to place the vat in the working position.

13. The method as recited in claim 12 wherein in the idle position, the overflow is positioned outside and not above the liquid metal bath.

* * * * *